United States Patent [19]

McGunn

[11] Patent Number: 5,035,187

[45] **Date of Patent: * Jul. 30, 1991**

[54] SAFE WITH COLOR-CODED DRAWERS EMPTYING INTO COLOR-CODED CONTAINERS

[75] Inventor: Edward T. McGunn, Indian Head Park, Ill.

[73] Assignee: McGunn Safe, Inc., Chicago, Ill.

[ * ] Notice: The portion of the term of this patent subsequent to May 8, 2007 has been disclaimed.

[21] Appl. No.: 517,374

[22] Filed: May 1, 1990

Related U.S. Application Data

[63] Continuation of Ser. No. 253,040, Oct. 4, 1988, Pat. No. 4,922,837.

[51] Int. Cl.[5] ..... E05G 1/00

[52] U.S. Cl. ..... 109/46; 109/53; 109/56

[58] Field of Search ..... 109/45, 46, 53, 55-57, 109/66, 70, 49, 54; 312/211, 212

[56] References Cited

U.S. PATENT DOCUMENTS

| | | | |
|---|---|---|---|
| 1,370,167 | 3/1921 | Thompson | 109/46 |
| 1,506,491 | 8/1924 | Kline | 109/46 |
| 2,008,119 | 7/1935 | Williams | 109/66 |
| 3,683,826 | 8/1972 | Rieckmann | 109/46 |
| 3,970,010 | 7/1976 | Cantley | 109/56 |
| 4,548,353 | 10/1985 | Howard et al. | 109/53 X |
| 4,922,837 | 5/1990 | McGunn | 109/46 |

FOREIGN PATENT DOCUMENTS

| | | | |
|---|---|---|---|
| 29664 | 5/1922 | Denmark | 109/66 |

OTHER PUBLICATIONS

Major Safe Co., Inc. Advertisement, "Trim Safe Model TT87KG".

Major Safe Advertisement, "Major's Economy Serivce Station Island-Exact Change Safe".

Centurion Deposit Corporation Advertisement, "TSBD 2018 Multi 'Shutter Slot' Depository", p. 8, including Consumers Price List-Effective Jan. 1, 1986.

*Primary Examiner*—Robert L. Wolfe

*Assistant Examiner*—Suzanne L. Dino

*Attorney, Agent, or Firm*—Welsh & Katz, Ltd.

[57] ABSTRACT

A safe having multiple openings in the form of drawers, with each of the drawers having a different color. The material placed into any one of the drawers passes from the drawer into a container located below the drawer in the safe. Each of the containers bears the same color as the drawer with which it communicates. A door over the safe prevents the unauthorized access to or removal of the containers from the safe. Catches, attached to each of the drawers, prevent their unauthorized removal from the safe. Each of the drawers may also include a separate lock to prevent entrance into the drawer except by authorized individuals.

18 Claims, 1 Drawing Sheet

SAFE WITH COLOR-CODED DRAWERS EMPTYING INTO COLOR-CODED CONTAINERS

This is a continuation of application Ser. No. 7/253,040, filed Oct. 4, 1988, now U.S. Pat. No. 4,922,837.

BACKGROUND

Safes in commercial establishments, of course, hold valuables. These most often take the form of cash receipts and, on occasion, important documents.

In retail stores, various individuals deposit the cash receipts collected over a period of time into the safe for subsequent collection. Different individuals may have similar responsibilities at a particular establishment. This may result, for example, from the store having different departments. Several individuals, assigned to different departments, may deposit the receipts for those departments into a safe. Or, different individuals may make deposits for various time periods.

Naturally, the management or owner of the establishment will wish to keep track of the deposits made by the various individuals into the safe. Typically, the utilization of sacks having some identification, such as the name of the individual utilizing it, accomplishes this result.

However, individuals may, either accidentally or, with sinister intent, on purpose utilizing the incorrect identifiers. Thus, upon the detection of some error in the contents of the different sacks in the safe, the establishment may lack the knowledge to determine who placed the inappropriate deposit within the safe. This becomes a particularly serious problem when, in fact, various amounts of cash have not found their way into the safe. Tracking the deposits of the individuals with access to the safe represents, in this instance, a particularly important task. The safes currently finding use do not adequately provide for this determination.

SUMMARY

Conceptually, the safe having several openings into which different individuals place materials will allow the tracing of these materials to the depositors. To accomplish this, the safe will also include several containers within the safe. The materials deposited through one of the openings will go into an identifiable container inside the safe.

More particularly, the safe should include an enclosure having a first set of a plurality of openings. It will naturally have a further, generally larger, opening, which will permit entrance to the interior of the safe itself.

A second set of a plurality of containers should then hold the materials deposited through the openings. These containers naturally sit within the safe's enclosure.

A locking device prevents the unauthorized access to the containers. It also prevents an unauthorized individual from removing any of the containers from the safe's interior.

Lastly, a guiding means couples to the plurality of openings as well as the set of containers. It directs material placed in each of the particular openings into a particular container. Materials placed in two different openings, naturally, should then fall into two different particular containers.

In the most desired form, each of the openings represents a drawer removable from the safe. Each of the drawers may have a separate lock which only an authorized individual can open. The drawer typically may have a coding, such as a selected color, to readily and visually identify who may have access to it.

The containers may have the same colors as the drawers to which deposits may be made. A deposit placed in one the drawers will then enter the container having the same color coding.

To effectuate communication between the drawers and containers, the bottom of the drawer, upon its placement fully within the safe, may descend into its container. This provides a chute to help direct material placed within a drawer into the appropriate container. The partial removal of the drawer from the safe causes the bottom to return to its uppermost present position. This prevents a person properly opening the drawer from having access to the containers below.

The utilization of the safe involves passing a first portion of material into a first of a plurality of openings in an enclosure. This first portion of material is then guided into one of a plurality of containers placed within the enclosure.

Further, a second portion of material will then pass into a second opening different from the first opening. The method then guides the second portion of material into a different one of the containers sitting within the enclosure.

From time to time, the containers will undergo removal from the enclosure. However, the method also requires the prevention of the unauthorized access to or removal of the containers from the enclosure.

DETAILED DESCRIPTION

Figure 1:
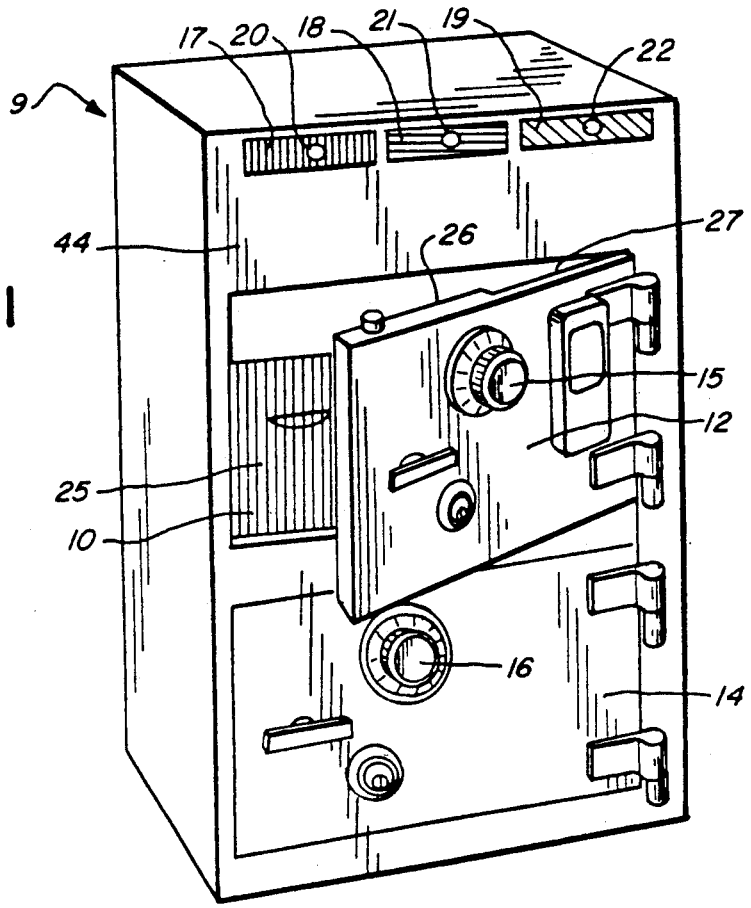
FIG. 1 shows an isometric view of a safe having color-coded drawers emptying color-coded containers.

FIG. 1 shows a safe generally at 9 having the main opening 10 and the lower opening 11. The door 12 closes the opening 10 while the door 14 accomplishes the same task for the lower opening 11. Lastly, the locks 15 and 16, sit on the doors 12 and 14 and prevent their unauthorized opening.

The drawers 17 to 19 sit near the top of the safe 9. Each of the drawers 17 to 19 has its respective locks 20 to 22, which serve to prevent the unauthorized opening of the drawers 17 to 19.

Alternately, the drawers 17 to 19 may not have any locks. In that case, the drawers 17 to 19 would merely carry knobs to assist in their opening.

Figure 2:
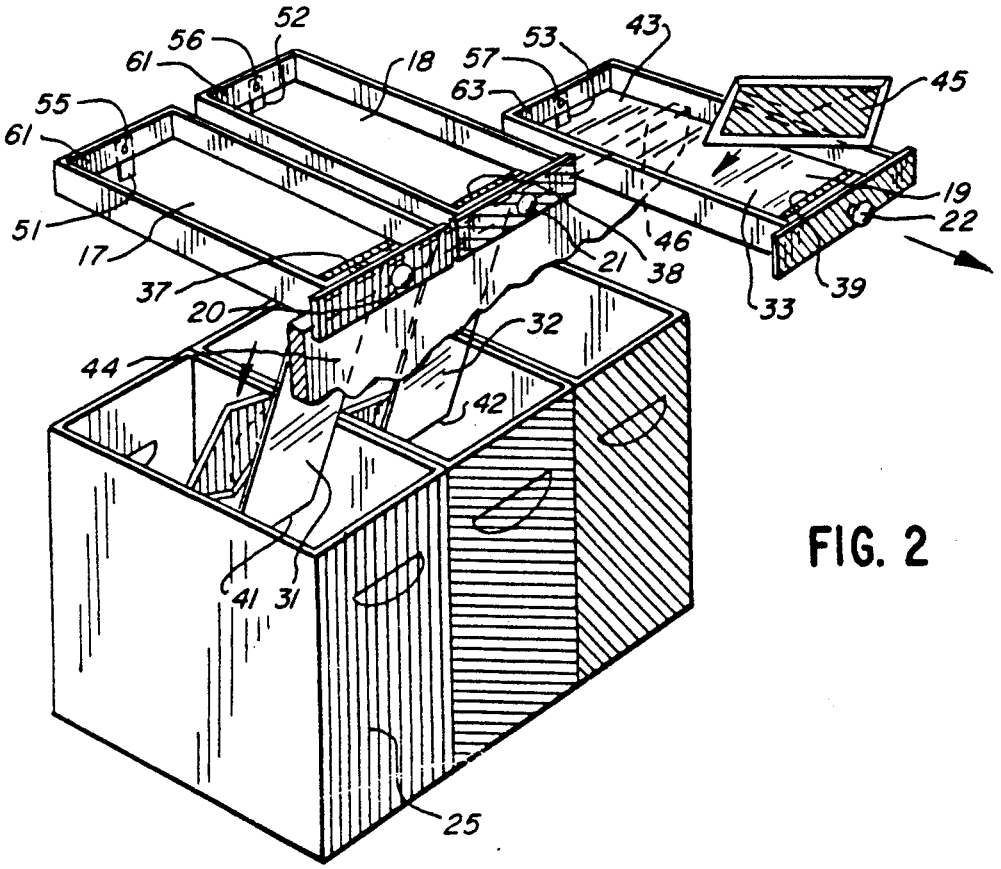
FIG. 2 gives a cut-away view of the safe of FIG. 1 showing the communication between the drawers and the containers.

As seen in FIGS. 1 and 2, the containers 25 to 27 sit in the interior of the safe 9. In fact, one of each of the containers 25 to 27 sits below one of each of the drawers 17 to 19.

As seen in the cutaway drawing of FIG. 2, the drawers 17 to 19 include the movable bottoms 31 to 33, respectively, connected through the hinges 37 to 39 to the remainder of the drawers 17 to 19. The hinged connections 37 to 39 allow the back ends 41 to 43 of the drawer bottoms 31 to 33 to swing downwards, as seen for the drawers 17 and 18 in FIG. 2.

Whether the drawer bottoms 31 to 33 occupy the raised or lowered position depends upon the placement of the drawers 17 to 19 relative to the front 44 of the safe 10. As seen in FIG. 2, the drawer 19 sits partially withdrawn from the front 44 of the safe 10. This position allows for the placement of the material 45 in the drawer. With the drawer 19 in the partially withdrawn configuration, however, the drawer bottom 33 sits upon the edge 46 formed in the front 44 of the safe by the opening through which the drawers 17 to 19 pass.

Thus, with the drawer 19 partially withdrawn from the safe through its front 44, the drawer bottom 33 rotates about its hinged connection 39 to occupy its raised position. This forms a compartment to hold the introduced material 45. More importantly, the elevated bottom 33 completely closes the lower side of the drawer 19 and prevents access to the container 27 located below the drawer 19. Thus, the opening of the drawer 19, or the drawers 17 or 18, rotates their bottoms 33, 31, and 32, respectively, into a position to prevent access through the drawers into the containers 27, 25, and 26 below.

The tabs 51 to 53 have the freely rotating connections 55 to 57 to the backs 61 to 63 of the drawers 17 to 19, respectively. Normally, the tabs 51 to 53 hang down in the position shown in the figure. In this configuration, they will abut against the safe's front 44 upon the almost full withdrawal of the drawers 17 to 19 from the safe. In fact, the tabs have the purpose of preventing the unauthorized removal of the drawers 17 to 19. This, in turn, precludes access to the containers 25 to 27 which the removal of the drawers would otherwise allow.

However, access to the tabs can be achieved through the safe's main door 12. A person permitted to open the door 12 can then rotate the tabs 51 to 53 to remove the drawers 17 to 19. Yet, this would not compromise the safe's security since this individual has access to the containers 25 to 27 anyways.

In fact, the rotating drawer bottoms 31 to 33 may provide sufficient security to entirely dispense with the locks 20 to 22 on the drawers 17 to 19. In this case, the drawers may simply have knobs to assist in their opening. Yet, the locks 20 to 22 may prove desirable in order to control who may place items within the containers 25 to 27. They would also prevent a person from accidentally placing deposits into the wrong container through the wrong drawer.

Accordingly, what is claimed is:

1. A safe for multiple users comprising:

(A) an enclosure with a first set of a plurality of openings;

(B) a second set of a plurality of containing means, with said second set being contained within said enclosure;

(C) a further opening in said enclosure of a size to permit the removal of the contents of said containing means;

(D) locking means for preventing the unauthorized access to said containing means or the removal of the contents of said containing means from said enclosure; and (E) guiding means, coupled to said first set of said plurality of openings and to said second set of containing means, for directing material in a particular one of said first set of openings into a particular one of said second set of containing means, materials being placed into two different ones of said first set of openings being directed into two different ones of said second set of containing means.

2. The safe of claim 1 wherein said locking means is a first locking means and further including second locking means, coupled to each of said openings in said first set, for preventing the unauthorized access through or introduction of material through said openings in said first set.

3. The safe of claim 2 wherein said first locking means may open regardless of whether said second locking means is locked or open.

4. The safe of claim 3 wherein each of said openings is a drawer, said second locking means includes a separate lock for each of said drawers, and wherein each of said separate locks opens to permit the partial removal of any one of said drawers regardless of whether the locks on the other drawers permit the partial removal of said other drawers.

5. The safe of claim 1 wherein said locking means includes a door completely covering said further opening with a lock preventing the unauthorized opening of said door.

6. The safe of claim 5 wherein each of said openings is a drawer located within said enclosure, said drawers being slidable in a direction to remove at least a portion of said drawer from said enclosure.

7. The safe of claim 6 further including restraining means, coupled to said drawers, for preventing the unauthorized complete removal of said drawers from said enclosure.

8. The safe of claim 6 wherein the containing means into which said guiding means guides materials introduced into one of said drawers is located below said one drawer for each of said drawers.

9. The safe of claim 8 wherein said guiding means includes, for each of said drawers, a chute from said one drawer to the containing means into which material placed into said one drawer passes.

10. The safe of claim 9 wherein each of said chutes includes, for each of said drawers, the bottom of said drawer, which, when said drawer is placed fully within said enclosure, descends toward the containing means into which material introduced into said drawer passes, said bottom of said drawer making contact with said enclosure when said drawer is partially removed from said enclosure, said bottom moving upwards when in contact with said enclosure.

11. The safe of claim 10 further including, for each of said drawers, coding means, coupled to said drawers, for indicating the identity of said drawers.

12. The safe of claim 11 wherein said coding means is a first coding means and further including second coding means, coupled to said containing means, for indicating the identity of said containing means.

13. The safe of claim 12 wherein said first and second coding means includes colors placed on said drawers and said containing means, with the color for each of said drawers being the same as the containing means into which material placed in said drawer passes.

14. A method of introducing material into a safe for multiple users comprising:

(A) passing a first portion of material into a first one of a set of a plurality of openings in an enclosure;

(B) guiding said first portion of material into one of a plurality of containing means within said enclosure;

(C) passing a second portion of material into a second one, different from said first one, of said set of said plurality of openings;

(D) guiding said second portion of material into another of said plurality of containing means different than said one container;

(E) removing the contents of said containing means from said enclosures; and (F) preventing the unauthorized access to said containing means or the unauthorized removal of the contents of said containing means from said enclosure.

15. The method of claim 14 further including preventing the unauthorized access through or introduction of material through said openings.

16. The method of claim 15 wherein said enclosure includes a further opening and the preventing of the unauthorized access to or removal of the contents of said containing means is accomplished by locking a door completely covering said opening.

17. The method of claim 16 wherein each of said plurality of openings is a drawer located within said enclosure and the introduction of material into said opening is accomplished by sliding said drawer in a direction to remove at least a portion of said drawer from said enclosure, placing said material in said drawer, and sliding said drawer back into said enclosure.

18. The method of claim 17 further including, for each of said drawers, first coding means, coupled to said drawers, for indicating the identity of said drawers and second coding means, coupled to said containing means, for indicating the identity of said containing means and wherein said first and second coding means includes colors placed on said drawers and said containing means, with the color for each of said drawers being the same as the containing means into which material placed in said drawer passes.

* * * * *